United States Patent [19]

Merkel

[11] Patent Number: 4,935,321

[45] Date of Patent: Jun. 19, 1990

[54] PHOTOGRAPHIC RECORDING MATERIAL COMPRISING A DYE IMAGE-FORMING COMPOUND

[75] Inventor: Paul B. Merkel, Rochester, N.Y.

[73] Assignee: Eastman Kodak Company, Rochester, N.Y.

[21] Appl. No.: 435,894

[22] Filed: Nov. 14, 1989

Related U.S. Application Data

[63] Continuation-in-part of Ser. No. 231,330, Aug. 12, 1988, which is a continuation-in-part of Ser. No. 99,172, Sep. 21, 1987, abandoned.

[51] Int. Cl.[5] ..... G03C 7/26; G03C 7/32; G03C 7/38; G03C 7/36

[52] U.S. Cl. ..... 430/17; 430/359; 430/543; 430/546; 430/551; 430/554; 430/555; 430/558

[58] Field of Search ..... 430/359, 543, 546, 551, 430/17, 554, 555, 558

[56] References Cited

U.S. PATENT DOCUMENTS

| | | | |
|---|---|---|---|
| 3,676,137 | 8/1970 | Mizuki et al. | 430/546 |
| 3,764,336 | 10/1973 | Nittel et al. | 430/546 |
| 4,171,975 | 10/1979 | Kato et al. | 430/548 |
| 4,547,459 | 10/1985 | Kamio et al. | 430/546 |
| 4,741,990 | 5/1988 | Sakamoto et al. | 430/551 |
| 4,820,614 | 4/1989 | Takada et al. | 430/551 |

FOREIGN PATENT DOCUMENTS

| | | | |
|---|---|---|---|
| 2805706 | 8/1978 | Fed. Rep. of Germany | 430/546 |
| 0030463 | 9/1976 | Japan | 430/546 |
| 1076054 | 7/1967 | United Kingdom . | |

OTHER PUBLICATIONS

J. of the Am. Chem. Soc., 73, 919–926; 1951.

*Primary Examiner*—Richard L. Schilling
*Attorney, Agent, or Firm*—Robert A. Linn

[57] ABSTRACT

This invention relates to a color photographic silver halide recording material containing a dye image-forming coupler compound and a carbonamide compound which is capable of altering the spectral absorption properties of a dye formed by reaction of the coupler compound with oxidized developing agent.

14 Claims, No Drawings

PHOTOGRAPHIC RECORDING MATERIAL COMPRISING A DYE IMAGE-FORMING COMPOUND

This is a continuation-in-part of U.S. patent application Ser. No. 231,330 filed Aug. 12, 1988, pending, which is a continuation-in-part of U.S. patent application Ser. No. 099,172, filed Sept. 21, 1987, now abandoned.

This invention relates to a color photographic silver halide recording material. In particular, the invention relates to an improved photographic recording material containing dye image-forming coupler compounds.

Color photographic recording materials generally contain silver halide emulsion layers sensitized to each of the blue, green and red regions of the visible spectrum, with each layer having associated therewith a color-forming compound which, respectively, yields a yellow, magenta or cyan dye. The quality of the resulting color image is primarily based on the dye hues obtained from the respective color-forming compounds.

Dye image-forming coupler compounds are frequently employed to provide the desired color image. A problem encountered with such couplers is that the spectral absorption characteristics of dyes obtained therefrom may not have the particular absorption maxima and distribution that are desired. Frequently, a dye which is obtained may have an absorption maximum as little as several nanometers removed from the optimum desired value, and therefore will not have the desired hue, notwithstanding this slight difference in absorption characteristics.

Attempts to alter absorption characteristics of dyes obtained from dye image-forming coupler compounds are usually focused on alterations of the structures of coupler compounds. This approach, while enjoying some measure of success, is time consuming and involves the expense of highly focused research programs. Success with such research is not predictable so that improvements in final hue values have been elusive even after concentrated research efforts.

Some coupler solvents are known to cause shifts in absorption values of dyes. For example, U.S. Pat. No. 3,676,137 describes use of a phosphate ester of a high boiling coupler solvent to shift absorption of a cyan dye to a shorter wavelength in order to reduce excessive red wavelength absorption. Alternatively, shifting absorption of a pyrazolone azomethine dye to a longer wavelength by use of a phenolic compound is known for *Journal of the American Chemical Society,* 73, 919 (1951).

British Patent Specification 1,076,054 describes a method for incorporating color couplers in gelatin-silver halide emulsions using a combination of a solvent miscible with alkaline solution and a water insoluble organic liquid having a boiling point above 150° C. The insoluble organic liquid can be a hydrocarbon, an ether, an ester, a ketone, an alcohol, an amide as well as various polymeric materials. The amide which is disclosed is N,N-dibutyllauramide.

This British Specification neither teaches nor suggests that the compounds of the type disclosed in this application have any utility with respect to altering absorption characteristics of dyes derived from dye forming couplers.

The need exists for a color photographic silver halide recording material having the capability of altering the spectral absorption properties of dyes so that absorption values thereof can be shifted over both broad and narrow ranges as compared with the inherent absorption characteristics of the dyes.

A color photographic recording material according to this invention comprises a support having thereon a light-sensitive silver halide emulsion layer, a coupler compound which is (i) a yellow or a cyan dye image-forming coupler or (ii) a magenta dye image-forming coupler, which is not an aldehydebis type 5-pyrazolone or a pyrazolino-[1,5-a]-benzimidazole magenta coupler, capable of forming a dye by reaction with oxidized color developing agent and, associated with the coupler, a fluorine free carbonamide compound which is capable of altering the spectral absorption of a dye formed from the coupler, said carbonamide compound having at least one of the structural formulae:

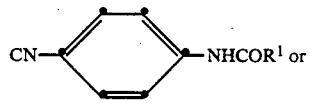

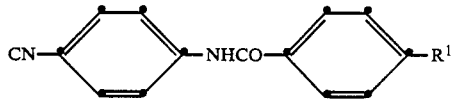

wherein:

$R^1$ is an alkyl group which is free of carboxylic or sulfo group substitution or salts thereof.

This invention also relates to a color photographic record comprising a dye formed by a coupling reaction between (i) a yellow or a cyan dye image-forming coupler or (ii) a magenta dye image-forming coupler, which is not an aldehydebis type 5-pyrazolone or a pyrazolino-[1,5-a]-benzimidazole magenta coupler, and oxidized silver halide developing agent, which record comprises, in association with the dye, a fluorine free carbonamide compound having at least one of the structural formulae:

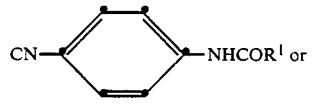

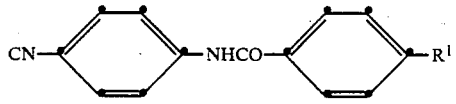

wherein;

$R^1$ is an alkyl group which is free of carboxylic or sulfo group substitution or salts thereof.

The alkyl groups which can be represented by $R^1$ can have from 1 to about 20 carbon atoms. Preferred alkyl groups have from 1 to about 12 carbon atoms. Such groups can be straight or branched chain and can be substituted. Chlorine is a preferred substituent.

The described carbonamide compounds can be synthesized by reacting an aliphatic or an aromatic acid chloride compound having the formula $R^1COCl$ with a primary aromatic amine compound of the formula:

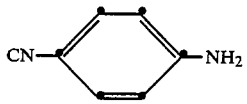

where $R^1$ has the meaning as described above, according to procedures known in the chemical art.

There are no particular restrictions on the quantity of carbonamide compound which can be employed with a dye image-forming compound either alone or when combined with known coupler solvents. Generally, it is desirable that the quantity of carbonamide compound, with respect to each part by weight of the coupler, be from about 0.05 to about 10 parts, preferably from about 0.2 to about 3 parts by weight of the coupler compound. As the amount of carbonamide compound increases, relative to the amount of coupler compound employed, there is usually a detectable increase in the extent of hue shift in the image dye. However, the particular choice of coupler, of carbonamide compound or the presence of one or more coupler solvents, all tend to influence the type and the extent of spectral absorption change in the resulting image dye.

Two or more carbonamide compounds may be used in combination to alter the spectral absorption properties of dyes as described herein.

When the coupler compound is added to a silver halide emulsion, conventional procedures may be employed. For example, the coupler can first be dissolved in one or more known coupler solvents, such as di-n-butyl phthalate (DBP), and then be mixed with a carbonamide compound as described herein. If desired, the coupler compound can be mixed with a carbonamide compound where these compounds are sufficiently compatible, so that known coupler solvents may not be needed. The resulting mixture or solution is then dispersed in aqueous gelatin, preferably containing a surfactant, and the dispersion is added to a silver halide emulsion which can then be coated by known techniques.

Preferred carbonamide compounds which are useful for shifting absorption values of dyes, including dyes obtained by the reaction of dye image-forming coupler compounds with oxidized color developing agents, include the following:

1.

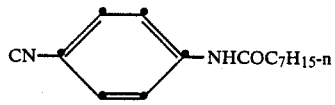

2.

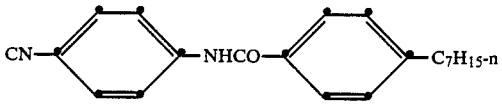

3.

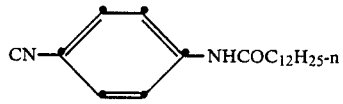

4.

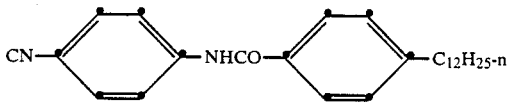

Couplers which form cyan dyes upon reaction with oxidized color developing agents are described in such representative patents and publications as U.S. Pat. Nos. 2,474,293; 2,772,162; 2,801,171; 2,895,826; 3,002,836; 3,419,390; 3,476,563; 3,779,763; 3,996,253; 4,124,396; 4,248,962; 4,254,212; 4,296,200; 4,333,999; 4,443,536; 4,457,559; 4,500,635 and 4,526,864, the disclosures of which are incorporated herein by reference.

Preferred cyan coupler structures are phenols and naphthols which form cyan dyes on reaction with oxidized color developing agent. These preferred structures include the following moieties:

C-1

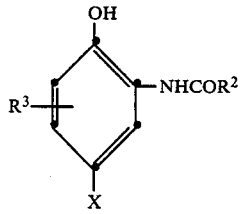

C-2

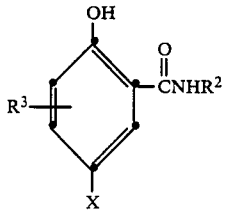

C-3

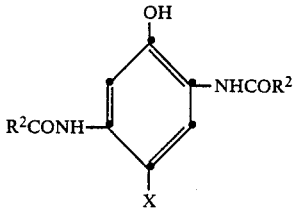

C-4

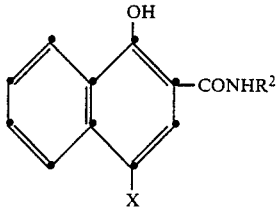

where $R^2$ represents a ballast gruop, $R^3$ represents one or more halogen atoms (e.g., chloro, fluoro), lower alkyl (e.g., methyl, ethyl, butyl) or lower alkoxy (e.g., methoxy, ethoxy, butoxy) groups and X is hydrogen or a coupling off group. An especially preferred $R^2$ is a ureido group, in particular, a cyano phenyl substituted ureido group of the type described in U.S. Pat. No. 4,333,999.

Magenta dye image-forming couplers, which are not aldehydebis 5-pyrazolone or pyrazolino-[1,5-]-benzimidazole magenta type couplers, which form magenta dyes upon reaction with oxidized color developing agents are described in such representative patents and publications as: U.S. Pat. Nos. 1,969,479; 2,311,082; 2,343,703; 2,369,489; 2,600,788; 2,908,573; 3,061,432; 3,062,653; 3,152,896; 3,519,429; 3,725,067; 4,120,723; 4,500,630; 4,540,654 and 4,581,326; and European Patent Publication Nos. 170,164 and 177,765; and copending U.S. application Ser. Nos. 23,517 of S. Normandin et al; 23,518 of R. Romanet et al; 23,519 of A. Bowne et al and 23,520 of A. Bowne et al, all filed Mar. 9, 1987, the disclosures of which are incorporated herein by reference.

Preferred magenta couplers include pyrazolones compounds having the structural formulae:

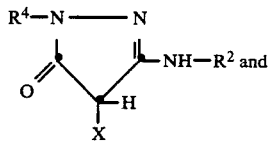

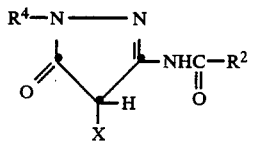

pyrazolotriazole compounds having the structural formulae:

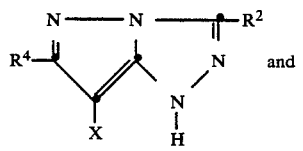

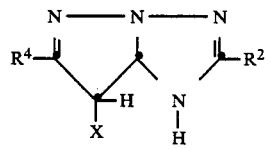

pyrazolobenzimidazole compounds having the structural formulae:

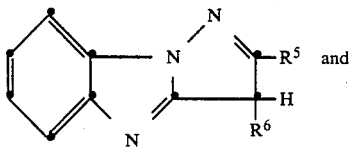

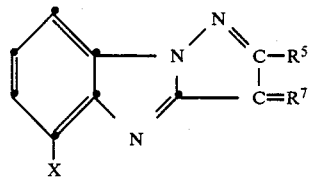

and indazole compounds having the structural formula:

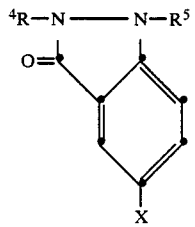

wherein

X is as defined above;

$R^2$ is a ballast group;

$R^4$ is halogen (e.g., chloro, fluoro), alky or alkoxy having from 1 to 4 carbon atoms, phenyl or substituted phenyl (e.g., 2,4,6-trihalophenyl);

$R^5$ is hydrogen or a movement organic radical, for example a saturated or unsaturated alkyl group having from 1 to about 20 carbon atoms (methyl, ethyl, propyl, butyl, decyl, dodecyl, heptadecyl, octadecyl); a cycloalkyl group (e.g. cyclohexyl); an aralkyl group (e.g. benzyl); an aryl group (e.g. phenyl, alkoxyphenyl in which the alkyl or alkoxy radical has from 1 to about 20 carbon atoms, nitrophenyl, aminophenyl, acylaminophenyl, alkylaminophenyl, naphthyl, diphenyl, diphenylether, diphenylthioether); a heterocyclic group (e.g. α-furyl, α-benzofuryl, α-pyridyl); an amino, hydroxy or carboxylic acid group, it being possible for the hydrogen atoms of these groups to be substituted, for instance by a mono- or dialkylamino group in which the alkyl groups have from 1 to about 20 carbon atoms; a cycloalkylamino group; an amino group in which one hydrogen atom is replaced by a pyrazolo-[1,5-a]-benzimidazolyl radical which is bonded in 3- position to said nitrogen atom so that couplers result in which two pyrazolo-[1,5-a]-benzimidazolyl radicals are connected by an amino group, and in which the remaining hydrogen atom may be replaced by a substituent such as an alkyl-, aryl-, aralkyl- or acyl- radical; an acylamino group in which the acyl radical is derived from an aliphatic, aromatic or heterocyclic carboxylic acid; a carboxylic acid group which is esterified by means of an aliphatic, cycloaliphatic or aromatic alcohol or by an aromatic compound having a phenolic hydroxy group; or a carboxyamido group in which the amido group may be substituted for example by a saturated or unsaturated alkyl, aralkyl, aryl or heterocyclic group;

$R^6$ represents a hydrogen atom, a sulphonic acid or a carboxylic acid group; a halogen atom (e.g. chlorine or bromine); or an azo radical —N=$NR^{11}$, wherein $R^{11}$ can be an aromatic or heterocyclic radical (phenyl, naphthyl, diphenyl, diphenylether, benzthiazolyl, pyridyl, quinolyl or pyrazolyl) which may be substituted such as by an alkyl group having from 1 to about 20 carbon atoms, hydroxy, alkoxy, halogen, amino, substituted amino, nitro, sulphonic acid or carboxylic acid groups;

$R^7$ represents a divalent radical such as

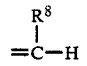

wherein $R^8$ can be alkyl, aralkyl, especially phenyl, phenyl substituted preferably in the p-position by a tertiary amino group such as a dialkylamino group in which at least one of the alkyl groups is substituted by carboxy, sulpho, hydroxy, alkoxy, carboxylalkyl, cyano or the divalent radical

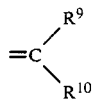

wherein $R^9$ and $R^{10}$ represent aliphatic, aromatic, araliphatic or heterocyclic radicals.

Specific magenta dye forming coupler compounds which are useful in the practice of this invention include:
M-1
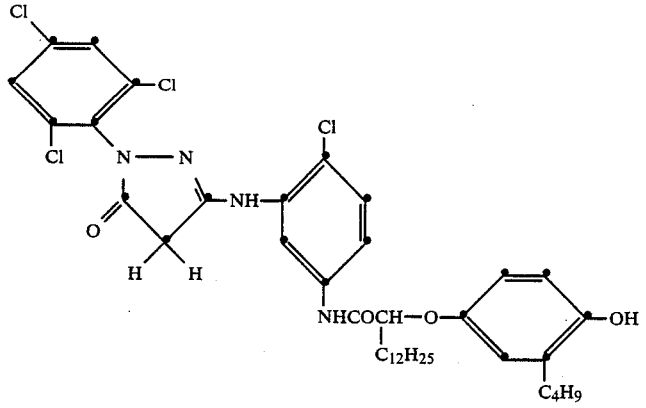
M-2
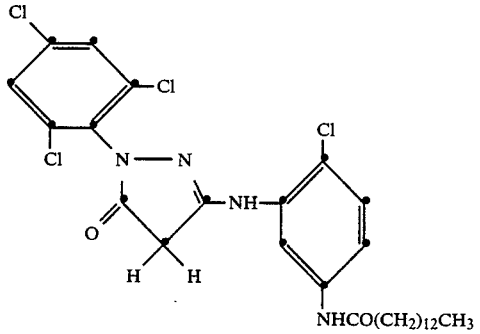
M-3
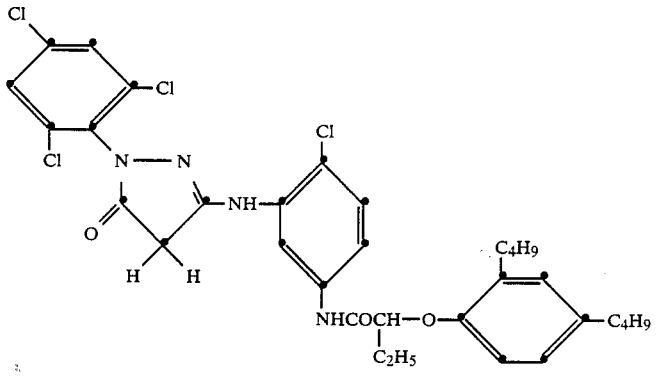
M-4
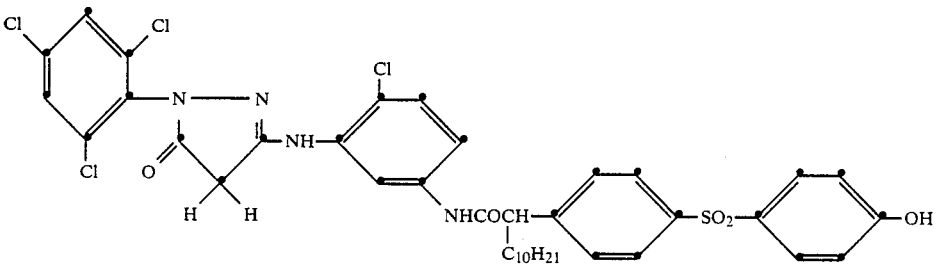

-continued
M-5
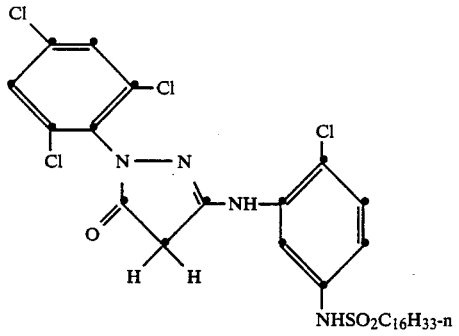
M-6
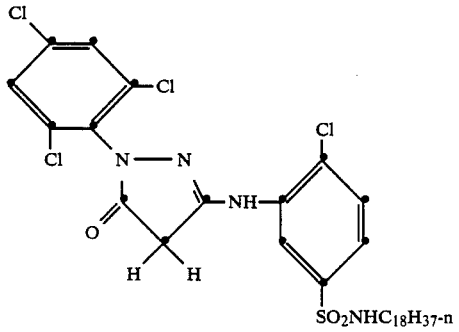
M-7
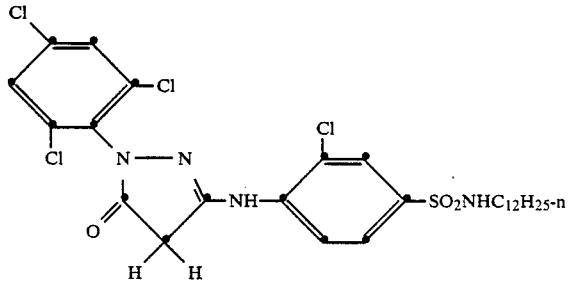
M-8
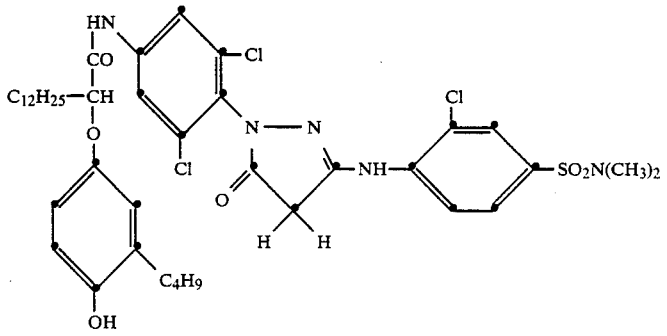

-continued
M-9
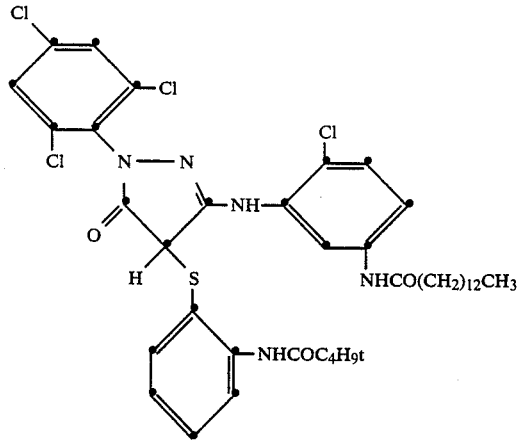
M-10
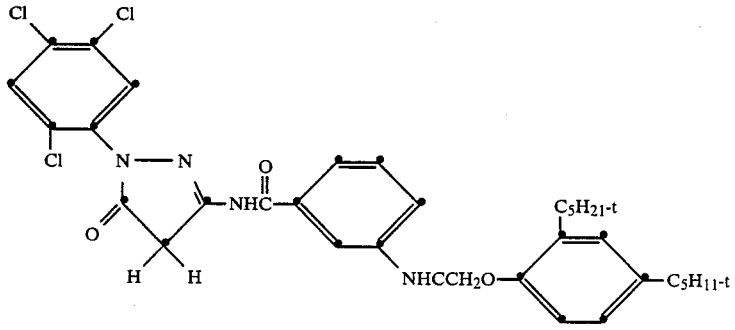
M-11
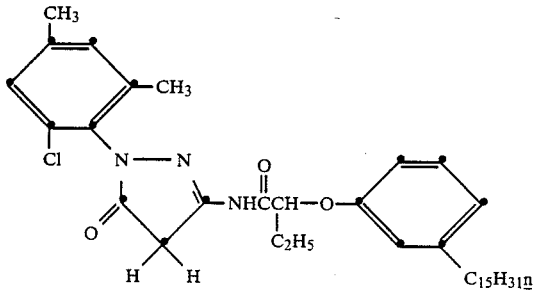
M-12
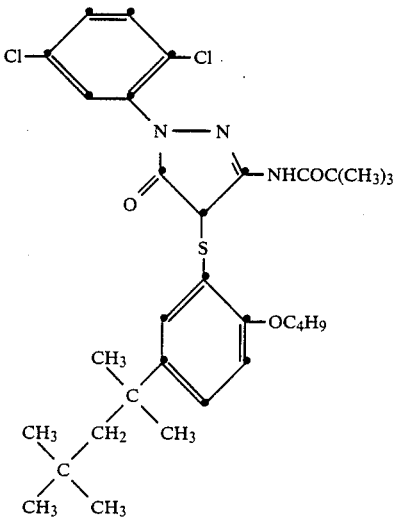

-continued
M-13
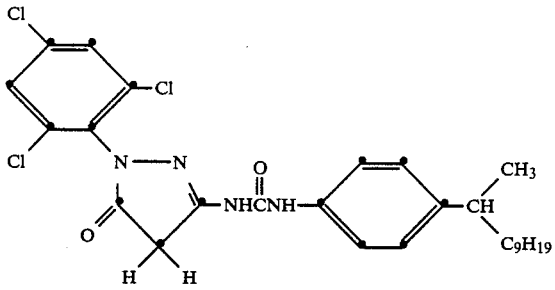
M-14
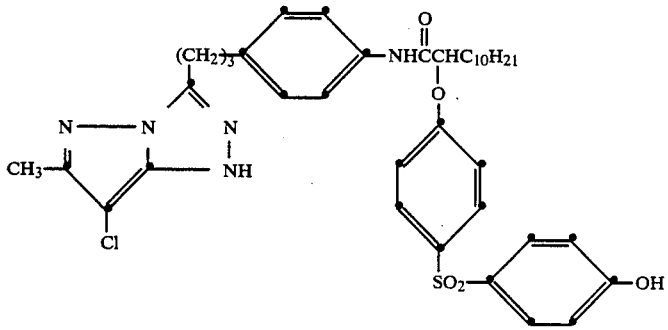
M-15
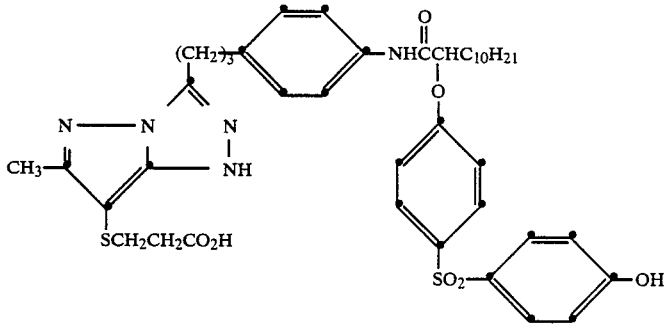
M-16
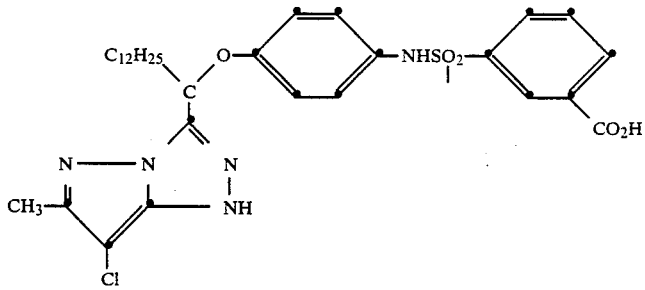
M-17
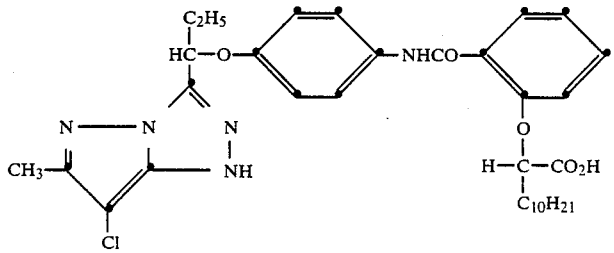

-continued
M-18
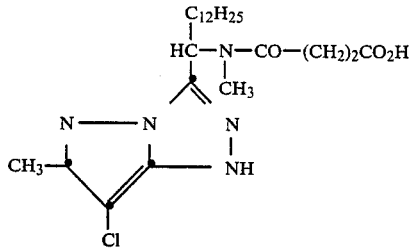
M-19
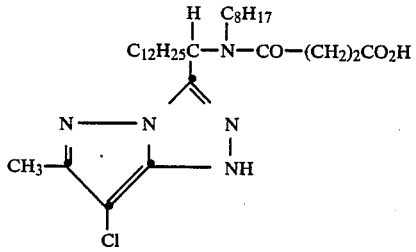
M-20
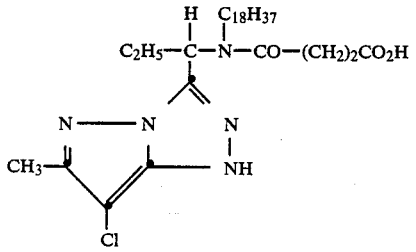
M-21
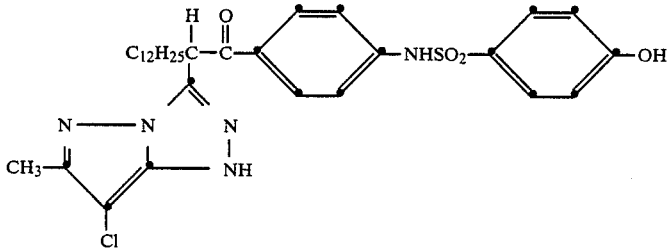
M-22
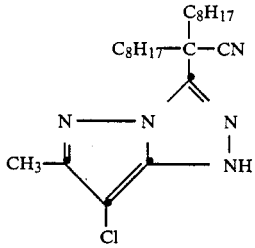
M-23
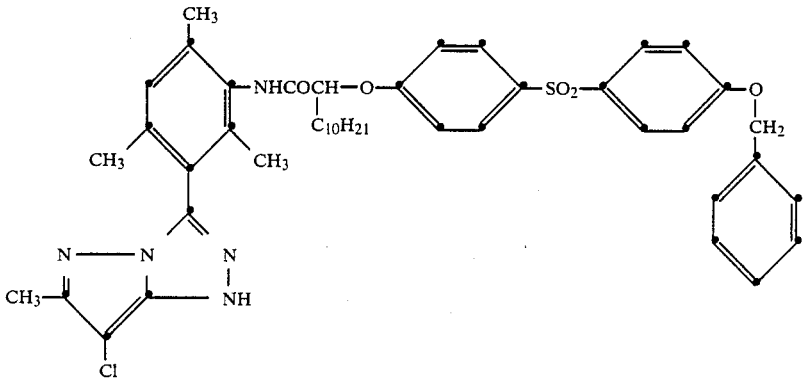

-continued
M-24
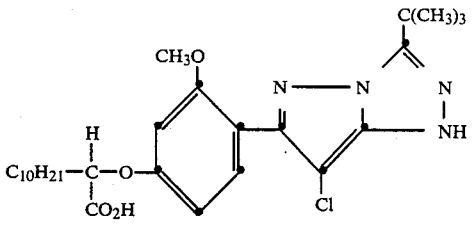
M-25
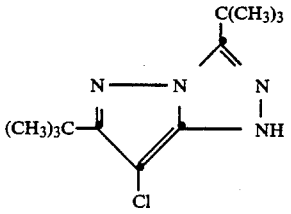
M-26
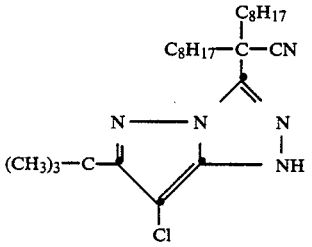
M-27
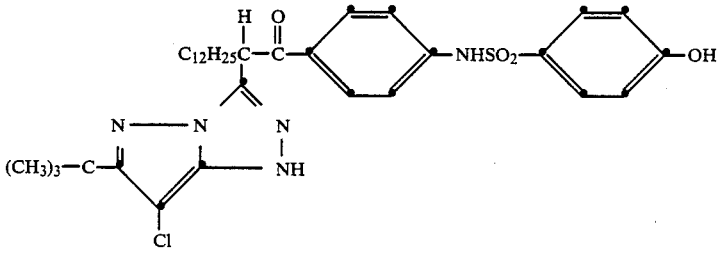
M-28
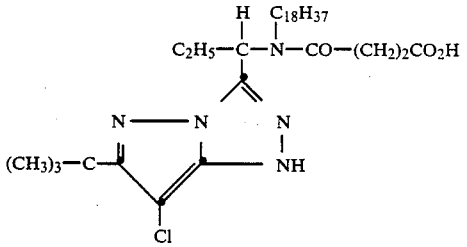
M-29
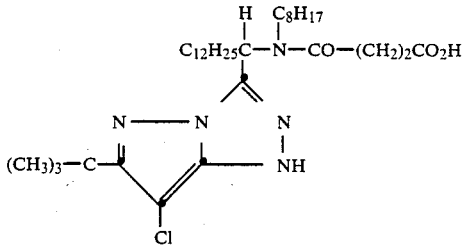

-continued
M-30
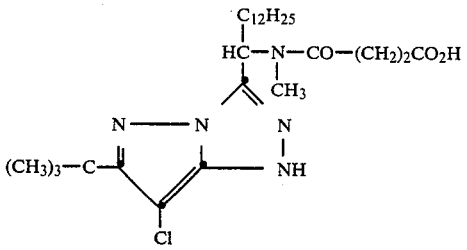
M-31
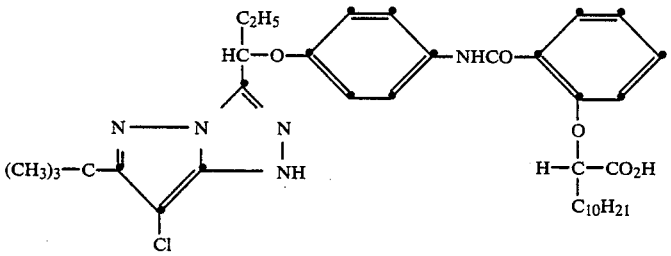
M-32
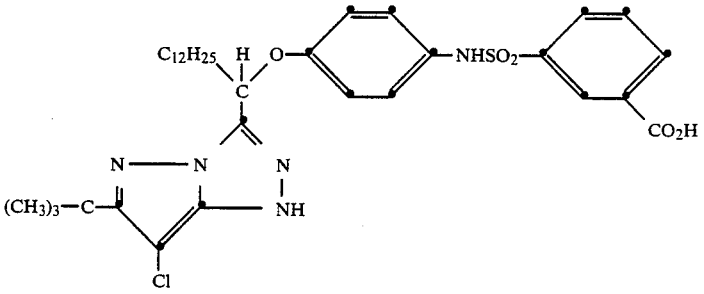
M-33
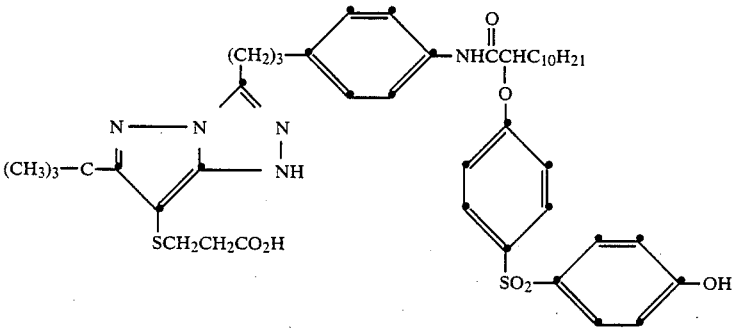
M-34
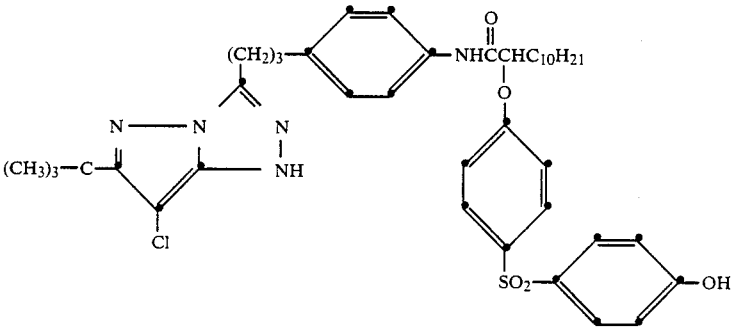

-continued
M-35
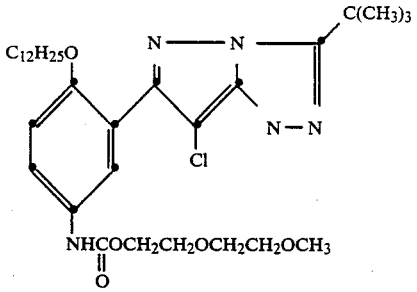
M-36
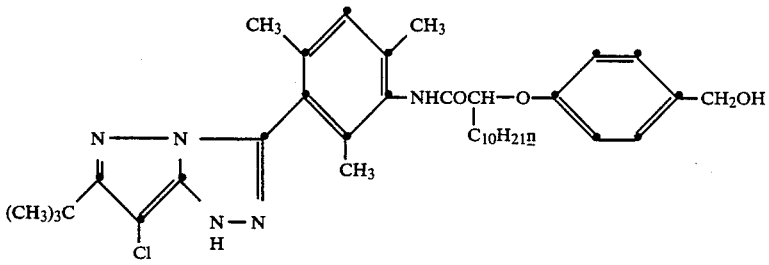
M-37
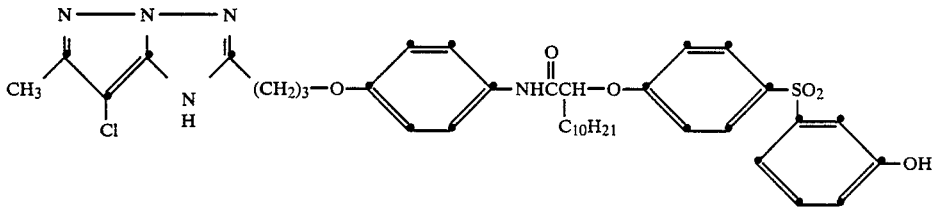
M-38
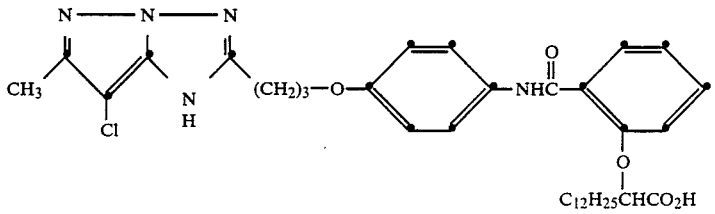
M-39
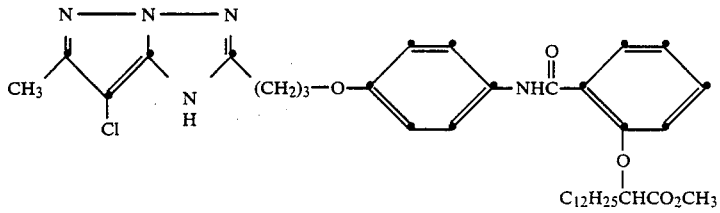
M-40
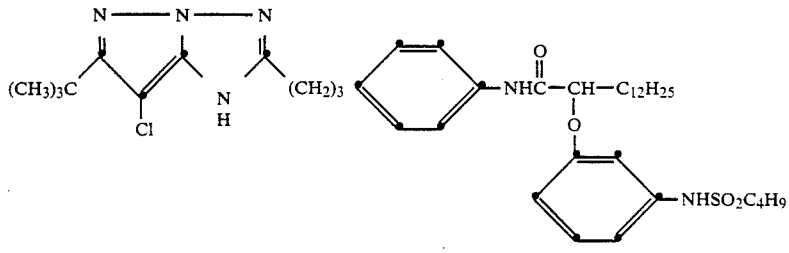

-continued

M-41

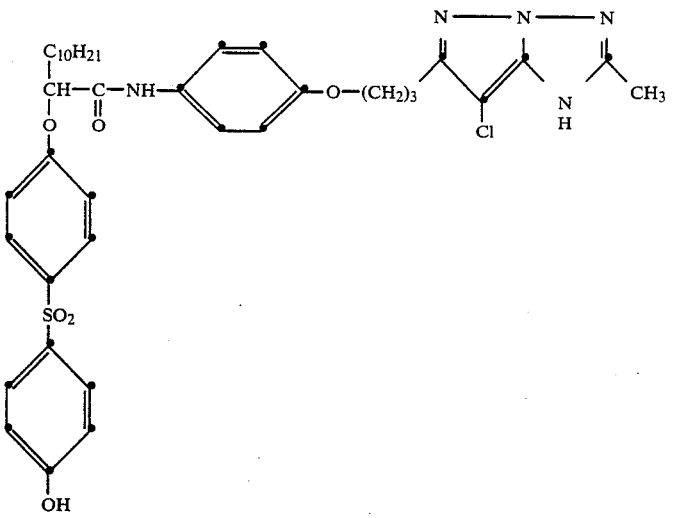

Couplers which form yellow dyes upon reaction with oxidized color developing agent are described in such representative U.S. Pat. Nos. as 2,298,443; 2,875,057, 2,407,210; 3,265,506; 3,384,657; 3,408,194; 3,415,652; 3,447,928; 3,542,840; 4,046,575; 3,894,875; 4,095,983; 4,182,630; 4,203,768; 4,221,860; 4,326,024; 4,401,752; 4,443,536; 4,529,691; 4,587,205; 4,587,207 and 4,617,256 the disclosures of which are incorporated herein by reference.

Preferred yellow dye image-forming couplers are acylacetamides, such as benzoylacetanilides and pivalylacetanilides. Structures of such preferred coupler moieties are:

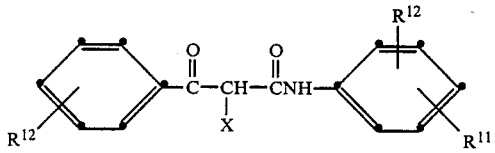

Y-1

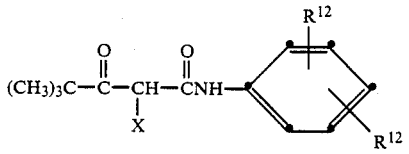

Y-2 where $R^{11}$ is as defined above, $R^{12}$ is hydrogen or one or more halogen, lower alkyl (e.g. methyl, ethyl) or a ballast (e.g. alkoxy of 16 to 20 carbon atoms) group and X is a coupling off group.

Photographic elements in which the photographic couplers of this invention are incorporated can be simple elements comprising a support and a single silver halide emulsion layer, or they can be multilayer, multicolor elements. The coupler compounds of this invention can be incorporated in the silver halide emulsion layer or in another layer, such as an adjacent layer, where they will come into reactive association with oxidized color developing agent which has developed silver halide in the emulsion layer. The silver halide emulsion layer can contain, or have associated therewith, other photographic coupler compounds, such as color forming couplers, colored masking couplers, etc. These other photographic coupler compounds can form dyes of the same or different color and hue as the photographic coupler compounds of this invention. Additionally, the silver halide emulsion layer can contain addenda conventionally contained in such layers.

A typical multilayer, multicolor photographic element according to this invention comprises a support having thereon a red-sensitive silver halide emulsion layer having associated therewith a cyan dye image-forming coupler compound, a green-sensitive silver halide emulsion layer having associated therewith a magenta dye image-forming coupler compound and a blue-sensitive silver halide emulsion layer having associated therewith a yellow dye image-forming coupler compound, wherein at least one dye image-forming coupler compound has associated therewith a carbonamide compound as described herein. Each silver halide emulsion layer can be composed of one or more layers and the layers can be arranged in different locations with respect to one another. Typical arrangements are described in U.S. Pat. Nos. 3,227,554; 3,620,747; 3,843,369; and 4,400,463 and in U.S. Pat. No. 923,045.

The light sensitive silver halide emulsions can include coarse, regular of fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direc-positive emulsions. They can form latent images predominantly on the surface of the silver halide grains or predominently on the interior of the silver halide grains. They can be chemically and spectrally sensitized. The emulsions typically will be gelatin emulsions although other hydrophilic colloids can be used in accordance with usual practice.

The support can be of any suitable material used with photographic elements. Typically, a flexible support is employed, such as a polymeric film or paper support. Such supports include cellulose nitrate, cellulose acetate, polyvinylacetal, polyethylene terephthalate, polycarbonate and resinous materials as well as glass, paper or metal. Paper supports can be acetylated or coated with baryta and/or an α-olefin polymer, particularly a polymer of an α-olefin containing 2 to 10 carbon atoms such as polyethylene, polypropylene or ethylene-butene copolymers.

Further details regarding silver halide emulsions and elements, and addenda incorporated therein can be found in *Research Disclosure*, Dec. 1971, Item 9232, Paragraphs I through XVIII. *Research Disclosure* is published by Industrial Opportunities Ltd., Homewell, Havant, Hampshire, PO9 1EF, United Kingdom.

The terms "in association" and "associated with" are intended to mean that materials can be in either the same or different layers so long as the materials are accessible to one another.

EXAMPLE 1

Hue shifting of preformed dyes

Dyes were dissolved in the coupler solvent, di-n-butyl phthalate (DBP), with or without a carbonamide compound, and coated in a gelatin vehicle in single layers.

A solution of 10 ml (12.5% solution) of photographic grade gelatin and 10 ml (0.4% aqueous solution) of duPont Alkanol XC were added to each solution of dye as described below. The indicated weight ratio of carbonamide compound dissolved in 1 ml of ethyl acetate was then added.

This mixture was passed five times through a colloid mill and 0.2 ml (10% solution) Olin Corp. 10 G surfactant and 0.05 ml (5% solution) formaldehyde were added. The milled mixture was then coated on a poly(ethyleneterephthalate) support, 100 μm wet thickness, and dried at 49° C. After 24 hours, the coating was heated for 5 minutes, dried, and spectrophotometric absorption maxima values were obtained.

The following Table shows that carbonamide compounds as described herein are capable of shifting the absorption maxima of dyes to usefully longer wavelengths. As these dyes are preformed and avoid wet processing, this experiment indicates the concept of hue shifting is applicable to other than photographic systems. The extent of hue shifting depends upon the specific dye and carbonamide compound (CC) and also varies with the dye: carbonamide compound ratio. The Table reflects the Dye:DBP:(CC) ratio used in each test.

TABLE

| Dye Compound | Carbonamide Compound | Weight Ratio Dye:DBP:(CC) | λ-max, nm |
|---|---|---|---|
| A | none (control) | 1:3:0 | 532 |
| A | 1 | 1:2:1 | 536 |
| A | 2 | 1:2:1 | 537 |
| B | none (control) | 1:3:0 | 533 |
| B | 1 | 1:2:1 | 549 |
| C | none (control) | 1:3:0 | 639 |
| C | 1 | 1:2:1 | 649 |
| C | 2 | 1:2:1 | 651 |

As is demonstrated by the data in the Table hue shifts to longer wavelengths vary from only a few nanometers to as much as 16 nanometers depending upon the dye and the carbonamide compound used. These variations in wavelength shifts offer a high degree of manipulative control and provide an excellent, inexpensive means to obtain particularly desired hue values with a variety of dye types.

Dye Structures:

A

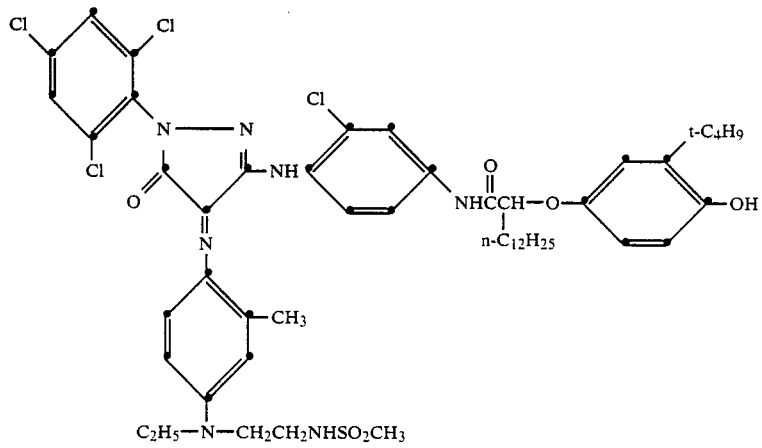

-continued

B

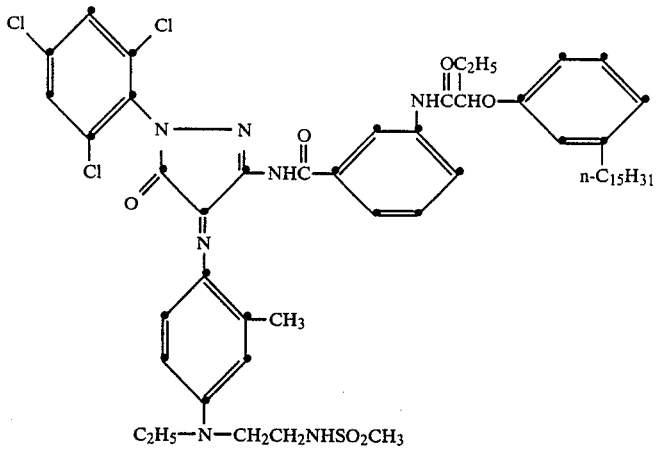

C

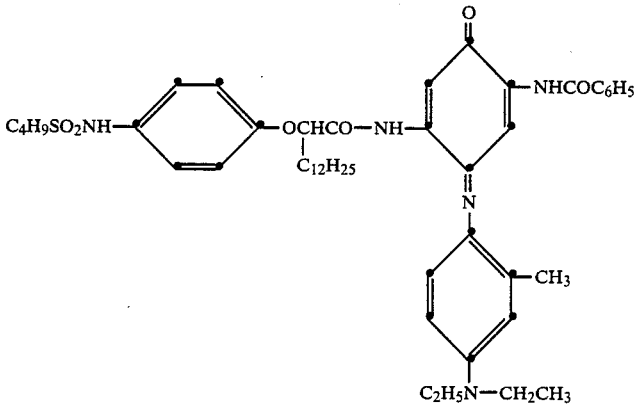

This invention has been described in detail with particular reference to preferred embodiments thereof, but it will be understood that variations and modifications can be effected within the spirit and scope of the invention.

What is claim is:

1. A color photographic recording material comprising a support having thereon a light-sensitive silver halide emulsion layer, a color coupler which is (i) a yellow or a cyan dye image-forming coupler or (ii) a magena dye image-forming coupler, which is not an aldehydebis type 5-pyrazolone or a pyrazolino-[1,5a]-benzimidazole magenta coupler, capable of forming a dye by reaction with oxidized color developing agent and, associated with the coupler, a fluorine free carbonamide compound which is capable of altering spectral absorption of a dye formed from the coupler, said carbonamide compound having at least one of the structural formulae:

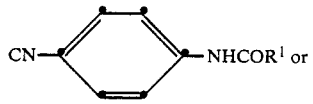

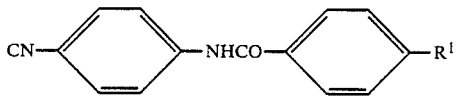

wherein;

$R^1$ is an alkyl group which is free of carboxylic or sulfo group substitution or salts thereof.

2. A photographic recording material according to claim 1 wherein $R^1$ has from 1 to about 20 carbon atoms.

3. A photographic recording material according to claim 2 wherein $R^1$ has from 1 to about 12 carbon atoms.

4. A photographic recording material according to claim 1 wherein the carbonamide compound is present in an amount of from about 0.05 to about 10 parts by weight of coupler compound.

5. A photographic recording material according to claim 4 wherein the carbonamide compound is present in an amount of from about 0.2 to about 3 parts by weight of coupler compound.

6. A photographic recording material according to claim 1 wherein the carbonamide compound has the structural formula:

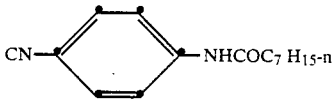

7. A photographic recording material according to claim 1 wherein the carbonamide compound has the structural formula:

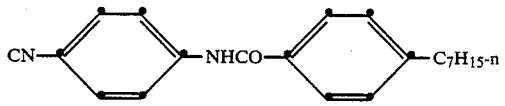

8. A photographic recording material according to claim 1 wherein the dye image-forming coupler is a cyan coupler compound.

9. A photographic recording material according to claim 1 wherein the dye image-forming coupler is a magenta coupler compound.

10. A color photographic record comprising a dye formed by a coupling reaction between (i) a yellow or a cyan dye image-forming coupler or (ii) a magenta dye image-forming coupler, which is not an aldehydebis type 5-pyrazoline or a pyrazolino-[1,5-a]-benzimidazole magenta coupler, and oxidized silver halide developing agent, which record comprises, in association with the dye, a fluorine free carbonamide compound having one of the structural formulae:

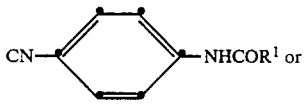

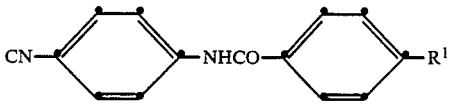

wherein;

$R^1$ is an alkyl group which is free of carboxylic or sulfo group substitution or salts thereof.

11. A photographic record according to claim 10 wherein the dye is formed from a cyan coupler compound.

12. A photographic record according to claim 1 wherein the dye is formed from a pyrazolone magenta coupler compound.

13. A photographic record according to claim 1 wherein the dye is formed from a pyrazolotriazole magenta coupler compound.

14. A photographic record according to claim 1 wherein the dye is formed from a indazole magenta coupler compound.

* * * * *